US011319689B1

(12) United States Patent
Mehrabi et al.

(10) Patent No.: US 11,319,689 B1
(45) Date of Patent: May 3, 2022

(54) NSMB PILE SPLICE SYSTEM FOR PRECAST CONCRETE PILES

(71) Applicants: Armin Mehrabi, Miami, FL (US); Seyed Saman Khedmatgozar Dolati, Miami, FL (US)

(72) Inventors: Armin Mehrabi, Miami, FL (US); Seyed Saman Khedmatgozar Dolati, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 17/490,702

(22) Filed: Sep. 30, 2021

(51) Int. Cl.
*E02D 5/52* (2006.01)
*E02D 5/58* (2006.01)
*E02D 5/30* (2006.01)

(52) U.S. Cl.
CPC ..... *E02D 5/526* (2013.01)

(58) Field of Classification Search
CPC ..... E02D 5/526; E02D 5/58
USPC ..... 405/252
See application file for complete search history.

(56) References Cited

U.S. PATENT DOCUMENTS 4,050,211 A * 9/1977 Wahman ..... E02D 5/523 403/294
4,938,635 A * 7/1990 Russell ..... E04B 1/215 405/252
2011/0002744 A1* 1/2011 Tadros ..... E02D 5/523 405/232

FOREIGN PATENT DOCUMENTS

CN 108330962 A * 7/2018
CN 111335303 A * 6/2020
CN 111636413 A * 9/2020
GB 2115467 A * 9/1983 ..... E02D 5/523
KR 2007022413 A * 2/2007

* cited by examiner

*Primary Examiner* — Frederick L Lagman
*Assistant Examiner* — Stacy N Lawson
(74) *Attorney, Agent, or Firm* — Saliwanchik, Lloyd & Eisenschenk

(57) ABSTRACT

Near-Surface Mounting Bar (NSMB) Pile Splice systems and methods are provided as an alternative splicing method to connect driven precast concrete pile segments. These systems are applicable to both unforeseen and preplanned splicing needs and provide excellent advantage especially for the unforeseen condition when other splice systems fail to provide the required capacity. These systems offer completely unique and new methods of connecting and splicing precast prestressed concrete pile segments and all other prismatic precast concrete elements.

20 Claims, 9 Drawing Sheets

NSMB PILE SPLICE SYSTEM FOR PRECAST CONCRETE PILES

GOVERNMENT SUPPORT

This invention was made with government support under 69A3551747121 awarded by U.S. Department of Transportation (USDOT). The government has certain rights in the invention.

BACKGROUND

Shipping and transportation constraints or other reasons often limit the length of prestressed-precast concrete piles (PPCP) segments that can be delivered to a bridge site or other construction site. Variable and unforeseen soil conditions may also require longer piles than anticipated. Hence, splicing of pile segments may be required at the construction site to achieve longer lengths using various types of joints. Connecting pile segments in a preplanned situation gives more choices for splicing types and allows preparing the receiving (lower) segment of piles with additional reinforcement, holes, and other embedment. However, in an unforeseen situation (e.g., because of unpredictable soil conditions) the prescribed length of driven piles cannot produce the required resistance and a need for splicing the piles arises. In such cases, the receiving (lower) segment of pile may not have been prepared or cast with splicing in mind, and therefore requires site preparation such as drilling holes to receive dowels. Because of practical limitations at the site, achieving the required capacity at the splice is in some cases not possible.

The application of Near Surface Mounted (NSM) reinforcement systems is known for strengthening of existing reinforced concrete (RC) elements and masonry structures. The use of NSM techniques with steel bars in Europe dates back to at least the early 1950s for strengthening RC structures. The implementation of stainless steel bars in the NSM method has been practiced to strengthen masonry buildings and arch bridges. In recent years, NSM techniques have used FRP bars due to their high strength and corrosion-resistant properties.

Most application of NSM with Fiber Reinforced Polymer (FRP) or Carbon Fiber Reinforced Polymer (CFRP) bars for concrete elements has been for flexural strengthening. De Lorenzis et al. (Strengthening of reinforced concrete structures with near surface mounted FRP rods. Int. Meet. Compos. Mater. PLAST, Citeseer; 2000, p. 9-11.) found that this method can increase the load-carrying capacity of RC beams in the range of 25 to 44 percent. After long-term tests, Astorga et al. (Behavior of a concrete bridge cantilevered slabreinforced using NSM CFRP strips. Constr Build Mater 2013; 40:461-72.) concluded that the NSM system with CFRP bars enhances the ultimate and yield load-bearing capacity of concrete bridge slabs by 41 and 20 percent, respectively. Barros et al. (Efficacy of CFRP-based techniques for the flexural and shear strengthening of concrete beams. Cem Concr Compos 2007; 29:203-17.) investigated RC beams retrofitted with NSM-CFRP system. They found that this method was more effective than the externally bonded (EB)-CFRP method in the ultimate load-carrying capacity of concrete members. Some applications of FRP NSM included prestressing them for flexural strengthening. The above applications refer to flexural strengthening of elements to increase their load carrying capacity.

Another application of the NSM system using FRP bars has been for shear strengthening of existing concrete elements (simply supported RC beams and deep RC T-beams). Barros and Dias (Near surface mounted CFRP laminates for shear strengthening of concrete beams. Cem Concr Compos 2006; 28:276-92.) experimentally investigated NSM shear strengthening technique with the use of CFRP strips. They found that this method improves the load-carrying capacity effectively for both reinforced concrete and unreinforced beams. Rizzo and De Lorenzis (Behavior and capacity of RC beams strengthened in shear with NSM FRP reinforcement. Constr Build Mater 2009; 23:1555-67.) after experimental tests on simply supported RC beams reinforced with NSM-FRP systems, found that the shear contribution of the system is 2.6 to 2.8 times higher than that of the EB-FRP system.

BRIEF SUMMARY

The application of NSM bars can be used for strengthening of beams, slabs, columns, and masonry wall systems. No related art systems or methods use NSM bars for precast concrete pile splices or for connecting prismatic concrete elements. Embodiments of the subject invention may advantageously connect separate precast elements to each other. Systems and methods of embodiments of the subject invention offer a unique and new method of connecting precast pile segments (splicing) and other precast concrete elements, including prismatic elements.

Embodiments of the subject invention provide novel and advantageous near-surface mounting bar (NSMB) pile splicing systems for connecting prestressed-precast concrete pile segments. In an embodiment, a splice system can comprise: a lower pile comprising prestressed-precast concrete, the lower pile having a lower end face and at least one lower lateral face; an upper pile comprising prestressed-precast concrete, the upper pile having an upper end face and at least one upper lateral face; and a splice connecting the upper pile and the lower pile. In an embodiment, the splice can comprise: a plurality of lower surface mount grooves on the lower lateral face; a plurality of upper surface mount grooves on the upper lateral face; and a plurality of NSMBs connecting the plurality of lower surface mount grooves to the plurality of upper surface mount grooves.

Embodiments may also provide a lower alignment element on the lower pile; an upper alignment element on the upper pile; a first reinforcing strip encircling a portion of the lower pile, a portion of the upper pile, or both; a lower reinforcing strip encircling a portion of the lower pile, a portion of the lower lateral face, a portion of the plurality of lower surface mount grooves, and a portion of the plurality of NSMBs; an upper reinforcing strip encircling a portion of the upper pile, a portion of the upper lateral face, a portion of the plurality of upper surface mount grooves, and a portion of the plurality of NSMBs.

Embodiments may have any or all of the following features: the first reinforcing strip encircling the lower end face and the upper end face; the lower reinforcing strip encircling a lower end of one or more of the plurality of NSMBs; and the upper reinforcing strip encircling an upper end of one or more of the plurality of NSMBs.

FRP strips can be easily wrapped over the NSM bars and concrete to assure confinement against peeling off and providing shear resistance. The width and thickness of strips also depend on the level of shear force to be transferred from one pile segment to the other. As an example, each strip can be 0.2-inch thick and applied in multiple layers to satisfy design.

Embodiments may have any or all of the following features: the lower pile being a prismatic pile comprising four planar lower lateral faces; the upper pile being a prismatic pile comprising four planar upper lateral faces; the lower alignment element being a cylindrical hole drilled, bored, or cast into a central region of the lower end face; and the upper alignment element being a cylindrical protrusion projecting from a central region of the lower end face; so that when the lower alignment element engages with the upper alignment element, the lower end face aligns with the upper end face, and each of the four planar lower lateral faces aligns with a corresponding one of the four planar upper lateral faces. Standard pile sizes of 12×12 inch through 30×30 inch can be spliced, though the system is applicable to any size, shape, and configuration of precast concrete piles.

Embodiments may have any or all of the following features: each of the four planar lower lateral faces comprising a respective lower surface mount groove of the plurality of lower surface mount grooves; and each of the four planar upper lateral faces comprising a respective upper surface mount groove of the plurality of upper surface mount grooves; so that when each of the four planar lower lateral faces aligns with a corresponding one of the four planar upper lateral faces, each respective lower surface mount groove aligns with each respective corresponding upper surface mount groove to form a respective splicing groove configured to receive the respective NSMB connecting the respective lower surface mount groove to the respective upper surface mount groove. The type and size of the bars can be determined as per design requirement. The size, shape, and configuration of the grooves can follow the relevant codes and specifications.

Embodiments may provide a filler or bonding agent connecting one or more of: the lower end face to the upper end face; the lower alignment element to the upper alignment element; and the plurality of NSMBs to the plurality of lower surface mount grooves, the plurality of upper surface mount grooves, or both. For example, installation of the NSM FRP pile splice system can involve employing grout and epoxy resin (bond material) that requires time for curing and reaching the required strength. Epoxy resins can have a tensile strength between 7000 to 10000 psi with a curing time in the range of 12 to 24 hours, which depends on the ambient temperature. As such, establishing and installation of the system can be performed in less than one day.

Embodiments may have any or all of the following features: the plurality of NSMBs comprising metallic, steel, stainless steel, or fiber reinforced plastic bars comprising a round, oval, elliptical, prismatic, rectilinear, rectangular, or square cross section; the plurality of lower surface mount grooves comprising cast, cut, or ground grooves comprising a round, oval, elliptical, prismatic, rectilinear, rectangular, or square cross section; the plurality of upper surface mount grooves comprising cast, cut, or ground grooves comprising a round, oval, elliptical, prismatic, rectilinear, rectangular, or square cross section; each groove of the plurality of lower surface mount grooves configured to align with a respective one of the plurality of upper surface mount grooves to receive a respective one of the plurality of NSMBs secured in place and inhibited from debonding by a bonding agent.

Embodiments may have any or all of the following features: the plurality of lower surface mount grooves comprising rectangular grooves between 15 mm (0.6 inches) and 38 mm (1.5 inch) in either depth or width or both; the plurality of upper surface mount grooves comprising rectangular grooves between 15 mm (0.6 inches) and 38 mm (1.5 inch) in either depth or width or both; the plurality of NSMBs comprising bars between 9 mm (0.35 inches) and 25.4 mm (1 inch) in either diameter or width; and a length of each of the plurality of NSMBs being equal to or less than a length of a corresponding one of the plurality of lower surface mount grooves plus a length of a corresponding one of the plurality of upper surface mount grooves; such that when each of the plurality of NSMBs connects a corresponding one of the plurality of lower surface mount grooves to a corresponding one of the plurality of upper surface mount grooves, a total gap between 3 mm (0.12 inches) and 6 mm (0.24 inches) is formed around each respective bar within each respective groove; the gap being filled by a bonding agent in a way that inhibits debonding of each respective bar.

Embodiments of the subject invention provide novel and advantageous methods for connecting driven pile segments. Embodiments may comprise the following steps: forming a lower alignment feature in a lower pile segment; forming an upper alignment feature in an upper pile segment; placing the upper pile segment on the lower pile segment; engaging the upper alignment feature with the lower alignment feature to align the upper pile segment to the lower pile segment; forming a plurality of lower surface mount grooves in the lower pile segment; forming a plurality of upper surface mount grooves in the upper pile segment; inserting a respective bar of a plurality of near surface mount bars (NSMBs) into a respective groove of the plurality of lower surface mount grooves and into a corresponding one of the plurality of upper surface mount grooves; and securing each respective bar with grout injection to form a near surface mount splice.

Embodiments may have any or all of the following features: each respective groove of the plurality of lower surface mount grooves being of a similar size, shape, position, and alignment with respect to a corresponding one of the plurality of upper surface mount grooves to facilitate inserting each respective bar with grout injection.

Embodiments provide methods comprising the step of securing each respective bar with at least one fiber reinforced polymer strip encircling at least a portion of the lower pile segment, the upper pile segment, or both.

Embodiments may have any or all of the following features: the lower alignment feature being a hole; the upper alignment feature being an alignment pin; the step of engaging the upper alignment feature with the lower alignment feature comprising inserting the alignment pin into the hole to bring the upper pile segment into alignment with the lower pile segment.

Embodiments may have any or all of the following features: the step of forming a plurality of lower surface mount grooves in the lower pile segment occurring at a construction site and after the step of engaging the upper alignment feature with the lower alignment feature to align the upper pile segment to the lower pile segment; each respective groove of the plurality of lower surface mount grooves being formed with a similar size, shape, position, and alignment by physical reference to a corresponding one of the plurality of upper surface mount grooves; the lower alignment feature being formed at the construction site, and at least in part by drilling, boring, or cutting into the lower pile segment; or the lower alignment feature being formed prior a delivery of the lower pile segment at the construction site, and at least in part by casting, drilling, boring, or cutting a hole into the lower pile segment.

Embodiments provide a NSMB pile splicing system for connecting prestressed-precast concrete pile segments, the system comprising: a lower pile comprising prestressed-precast concrete, the lower pile having a lower end face and at least one lower lateral face; an upper pile comprising prestressed-precast concrete, the upper pile having an upper end face and at least one upper lateral face; and a splice connecting the upper pile and the lower pile, the splice comprising: a plurality of lower surface mount grooves on the lower lateral face; a plurality of upper surface mount grooves on the upper lateral face; a plurality of near surface mount bars (NSMBs) connecting the plurality of lower surface mount grooves to the plurality of upper surface mount grooves; a lower alignment element on the lower pile; an upper alignment element on the upper pile; a first reinforcing strip encircling a portion of the lower pile, a portion of the upper pile, or both; a lower reinforcing strip encircling a portion of the lower pile, a portion of the lower lateral face, a portion of the plurality of lower surface mount grooves, and a portion of the plurality of NSMBs; and an upper reinforcing strip encircling a portion of the upper pile, a portion of the upper lateral face, a portion of the plurality of upper surface mount grooves, and a portion of the plurality of NSMBs; the first reinforcing strip encircling the lower end face and the upper end face; the lower reinforcing strip encircling a lower end of one or more of the plurality of NSMBs; and the upper reinforcing strip encircling an upper end of one or more of the plurality of NSMBs.

Embodiments may have any or all of the following features: the lower pile being a prismatic pile comprising four planar lower lateral faces; the upper pile being a prismatic pile comprising four planar upper lateral faces; the lower alignment element being a cylindrical hole drilled, bored, or cast into a central region of the lower end face; the upper alignment element being a cylindrical protrusion projecting from a central region of the lower end face, so that when the lower alignment element engages with the upper alignment element, the lower end face aligns with the upper end face, and each of the four planar lower lateral faces aligns with a corresponding one of the four planar upper lateral faces; each of the four planar lower lateral faces comprising a respective lower surface mount groove of the plurality of lower surface mount grooves; each of the four planar upper lateral faces comprising a respective upper surface mount groove of the plurality of upper surface mount grooves; so that when each of the four planar lower lateral faces aligns with a corresponding one of the four planar upper lateral faces, each respective lower surface mount groove aligns with each respective corresponding upper surface mount groove to form a respective splicing groove configured to receive the respective NSMB connecting the respective lower surface mount groove to the respective upper surface mount groove; a filler or bonding agent connecting one or more of: the lower end face to the upper end face; the lower alignment element to the upper alignment element; and the plurality of NSMBs to the plurality of lower surface mount grooves, the plurality of upper surface mount grooves, or both; the plurality of NSMBs comprising metallic, steel, stainless steel, or fiber reinforced plastic bars comprising a round, oval, elliptical, prismatic, rectilinear, rectangular, or square cross section; the plurality of lower surface mount grooves comprising cast, cut, or ground grooves comprising a round, oval, elliptical, prismatic, rectilinear, rectangular, or square cross section; the plurality of upper surface mount grooves comprising cast, cut, or ground grooves comprising a round, oval, elliptical, prismatic, rectilinear, rectangular, or square cross section; each groove of the plurality of lower surface mount grooves configured to align with a respective one of the plurality of upper surface mount grooves to receive a respective one of the plurality of NSMBs secured in place and inhibited from debonding by a bonding agent; the plurality of lower surface mount grooves comprising rectangular grooves between 6 mm (0.24 inches) and 25 mm (1 inch) in either depth or width or both; the plurality of upper surface mount grooves comprising rectangular grooves between 6 mm (0.24 inches) and 25 mm (1 inch) in either depth or width or both; the plurality of NSMBs comprising bars between 4 mm (0.16 inches) and 22.5 mm (0.89 inches) in either diameter or width; and a length of each of the plurality of NSMBs being equal to or less than a length of a corresponding one of the plurality of lower surface mount grooves plus a length of a corresponding one of the plurality of upper surface mount grooves; such that when each of the plurality of NSMBs connects a corresponding one of the plurality of lower surface mount grooves to a corresponding one of the plurality of upper surface mount grooves, a total gap between 2 mm (0.08 inches) and 21 mm (0.83 inches) is formed around each respective bar within each respective groove; and the gap being filled by a bonding agent in a way that inhibits debonding of each respective bar.

DETAILED DESCRIPTION

Figure 1A:
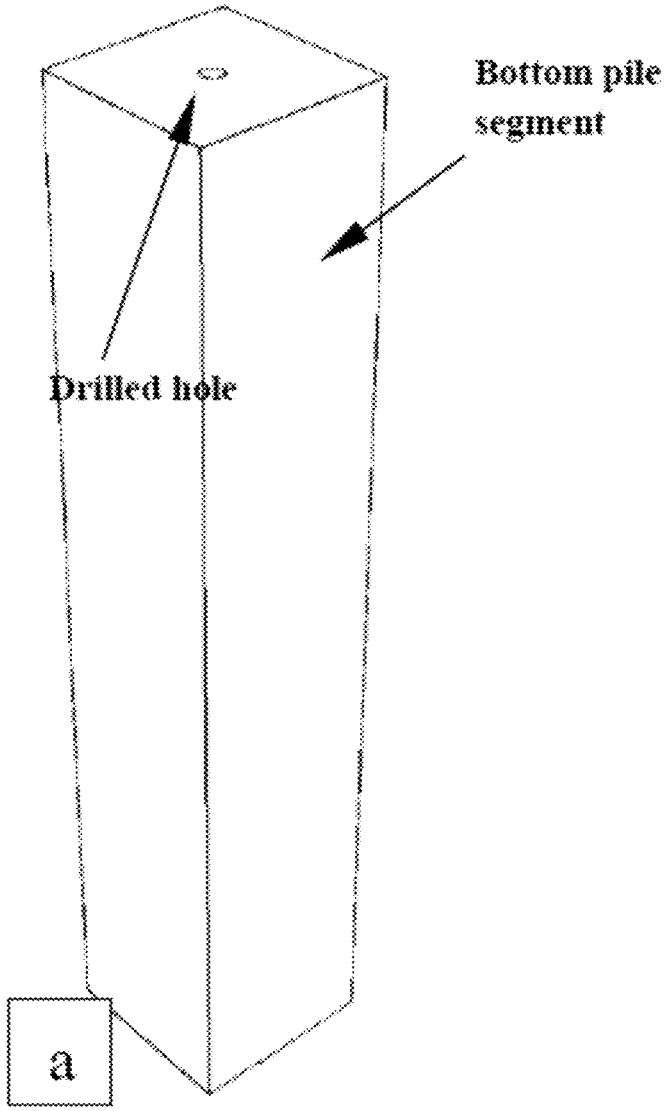
FIGS. 1A-1F illustrate a near-surface mounting bar (NSMB) pile splice system and method of making such system according to an embodiment of the subject invention.

Embodiments of the subject invention provide novel pile splicing systems including a near-surface mounting bar (NSMB) pile splice system useful to connect driven precast concrete pile segments. This system is applicable to both unforeseen and preplanned situations and provides excellent advantage especially for the unforeseen condition when other splice systems fail to provide the required capacity. Embodiments provide a completely unique and new method of connecting or splicing precast pile segments and many other prismatic precast concrete elements.

Embodiments are advantageous compared to existing methods for numerous reasons, including that they: a) may be applied considerably easier, b) require fewer or minimal modifications to the pile segments to be spliced, c) are is very labor-friendly and can save a great deal of time, d) are durable and corrosion-resistant and will perform better in corrosive environment, e) are lightweight and environmentally friendly, f) provide for the required strength rapidly to allow driving of the pile to continue, g) overcome the shortcomings of unforeseen splices that are unable to provide the required splice strength, h) and importantly, are applicable to both preplanned and unforeseen splices.

Embodiments have the potential to deliver major commercial impact and considerably improve the construction operation for splicing driven piles. Embodiments may also significantly enhance the strength and durability of spliced piles, especially for unforeseen splice conditions. The durability of pile splices in marine and corrosive environments will also be increased.

Certain embodiments are readily applicable to splicing of precast concrete piles for bridge and building foundations. While commercial embodiments may readily target application including precast concrete piles, embodiments can easily be adapted for splicing other concrete pile types as well as assembling columns, piers, and various structural concrete prismatic elements.

Embodiments of the subject invention including the NSMB Pile Splice concept were developed as an innovative alternative to existing methods of connecting driven pile segments both in unforeseen and preplanned situations. Embodiments provide excellent advantage especially for the unforeseen condition when other splice systems may fail to provide the required capacity. In certain embodiments, the system may include fiber reinforced polymer (FRP) bars, strips, and an alignment element. When splicing is needed, the pile driving operation pauses, the upper pile segment is lowered and erected on top of the lower segment. To help the operation, an alignment pin protruded from the upper pile segment may be placed into a hole at the center of the lower pile segment to facilitate the installation as well as ensure the alignment. This hole can be cast for the case of preplanned and drilled for the case of unforeseen splices. Filler or bonding compound (e.g., epoxy grout) may be used inside the alignment hole in the lower segment and at the touching surfaces of the two pile segments. In the next step, for the case of unforeseen splicing, longitudinal grooves with required length and dimension are cut into the concrete cover of pile segments on both sides of the splice at joint location. For the case of preplanned splicing, the grooves can be precut, ground, or cast at the precast plant. FRP bars are then placed into the grooves and bonded therein with a suitable grout or filler (e.g., epoxy or cementitious based material). FIGS. 1A-1F show a method for connecting driven pile segments in an unforeseen situation, the method according to an embodiment of the subject invention may include (a) drilling hole in lower pile segment, (b) and (c) cutting grooves and placing an alignment pin in the upper pile segment, (d) placing the upper segment on the lower segment, (e) cutting the same dimension of grooves in the lower segment, and (f) inserting the bars into the grooves with grout injection. An additional benefit of certain embodiments is that for the case of preplanned splicing, each segment can be prepared with some, all, or a pre-planned subset of modifications before shipping to the site which makes this method even easier and faster to be implemented.

Embodiments are readily applicable to splicing of precast concrete piles for bridge and building foundations. While certain commercial embodiments of this method may first target precast concrete piles, embodiments can easily be adapted for splicing other concrete pile types as well as assembling columns, piers, and many different structural concrete prismatic elements.

Embodiments provide an innovative NSMB Pile Splice system as an innovative alternative splicing method to connect driven precast concrete pile segments. Embodiments are applicable to both unforeseen and preplanned situations and provide excellent advantage especially for the unforeseen condition when other splice systems fail to provide the required capacity. Embodiments are advantageously adapted to be used in conjunction with precast concrete piles or for connecting separate prismatic concrete precast elements. Embodiments provide a uniquely beneficial new method of splicing and connecting precast pile segments and other prismatic precast concrete elements.

Turning now to the figures, FIGS. 1A-1F illustrate a near-surface mounting bar (NSMB) pile splice system and method of making such system according to an embodiment of the subject invention.

In FIG. 1A, a prismatic lower pile segment of reinforced concrete is depicted with a drilled hole in accordance with an embodiment of the subject invention. The hole may be pre-drilled at the precast plant, drilled at an intermediate site, or drilled on site prior to or during construction. Alternatively, the hole may be cast, ground, bored, or otherwise formed in the pile. The lower pile segment may be a common or standard size (e.g., 18 inches wide by 18 inches deep) or other size. The lower pile may be square as shown in FIG. 1A, rectangular, polygonal, round, oval, or other shapes. Prismatic, polygonal, and rectilinear cross sections have advantages of ease of alignment, in some cases symmetry, and large mating surfaces which may facilitate placement and fabrication of near surface mount features.

Figure 1B:
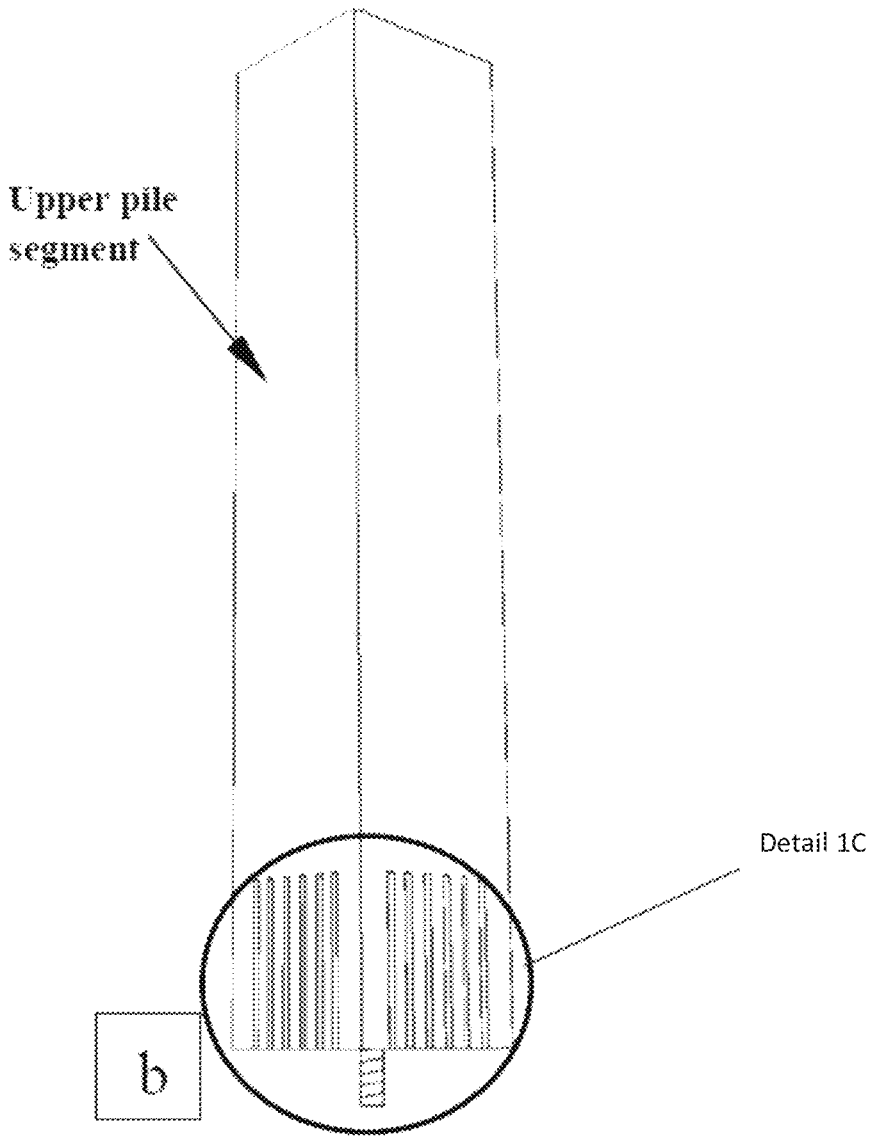

In FIG. 1B, a prismatic upper pile segment of reinforced concrete is depicted with an alignment pin and near surface mount grooves in accordance with an embodiment of the subject invention. The alignment pin may be pre-installed at the precast plant, mounted at an intermediate site, or mounted on site prior to or during construction. The alignment pin may be cast-in, press fit, epoxied, manufactured in place, or otherwise attached to the pile. The upper pile segment may be a common or standard size (e.g., 18 inches wide by 18 inches deep) or other size. The upper pile may be square as shown in FIG. 1B, rectangular, polygonal, round, oval, or other shapes. Prismatic, polygonal, and rectilinear cross sections have advantages of ease of alignment, in some cases symmetry, and large mating surfaces which may facilitate placement and fabrication of near surface mount features. A circle including the alignment pin and grooves in FIG. 1B indicates the area of focus for FIG. 1C.

In certain embodiments the upper pile may match or compliment the lower pile with respect to cross section, shape, alignment features, grooves. While certain features are shown in relation to the upper pile or lower pile, respectively, and while there may be specific advantages including ease of application to unexpected splice situations, ease of driving, fabricating, positioning, or handling one or both piles, cost, adaptability, or reliability; in certain embodiments it may be contemplated to associate a feature or a set of features with either the upper pile or the lower pile. For example, in an embodiment an alignment pin may be provided in the lower pile and an alignment hole provided in the upper pile.

Figure 1C:
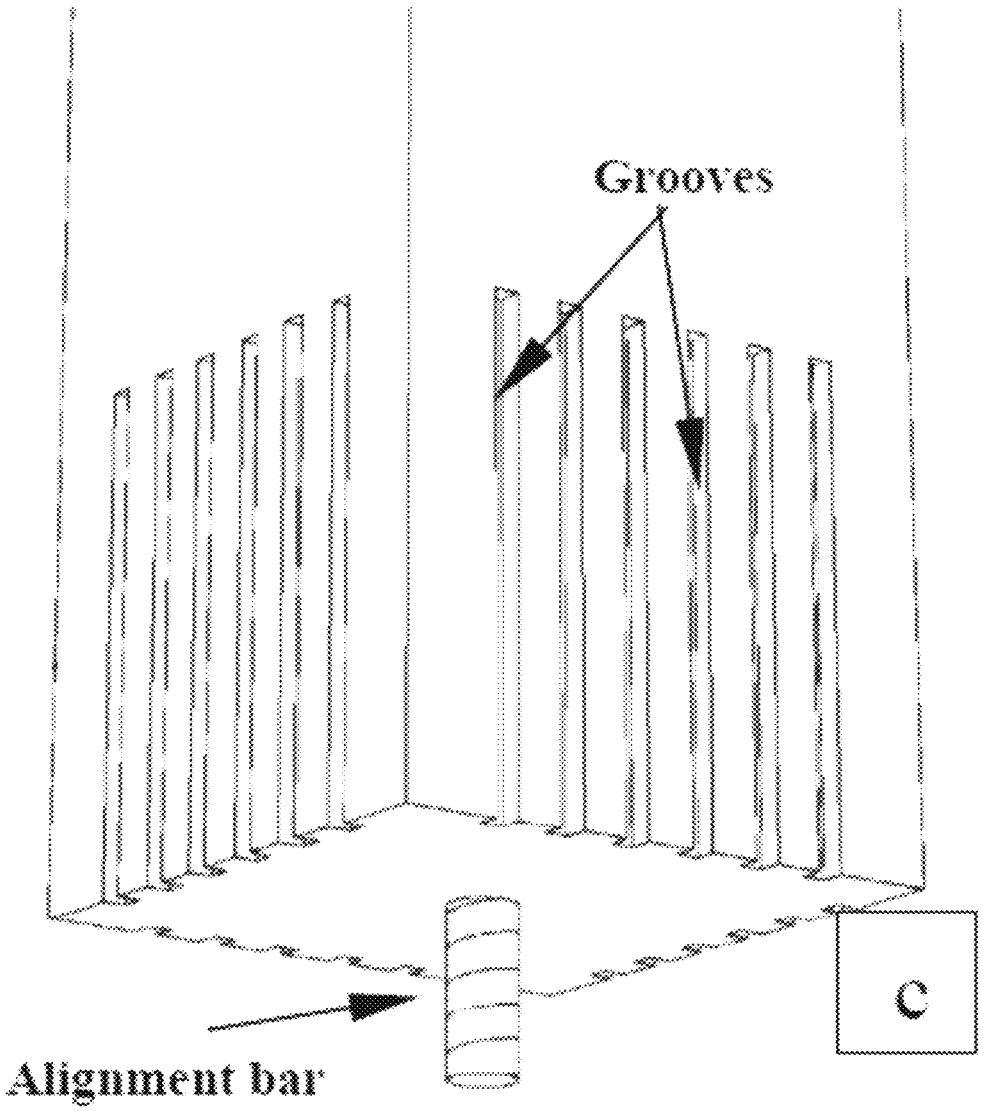

In FIG. 1C, a detailed view of an end of the upper pile depicted in FIG. 1B is shown. The end of the pile includes an alignment pin and a multiplicity of grooves configured to receive near surface mount bars. In this embodiment, six grooves can be seen on each side of a square pile. Other numbers of grooves (for example, 1, 2, 3, 4, 5, 6 (as shown), 7, 8, 9, 10, or more groove(s) per side may be used according to the requirements of a specific application and design.) Grooves are shown as square or nearly square in cross section, but could be other shapes including round, rectangular, triangular, or combinations such as a deep narrow rectangle with a full round bottom or with rounded or chamfered corners. Grooves may be cut or ground by a saw, chisel, water jet, grinding wheel, or other implement. Grooves may be precast or formed in place when the pile is made. Grooves may be sized to receive common or custom sizes or profiles of bars, including a nominal 10 mm (about 0.375") groove for a size 3 bar, or a nominal 13 mm (about 0.500") groove for a size 4 bar. Grooves may be oversized, undersized, or matched with respect to the bars they hold, and may include a sizing allowance for epoxy or grout filler to secure the bar. Grooves may be of the same cross section as the bars they hold, or of a different or complimentary shape or profile. By way of a non-limiting example, a 19 mm (about 0.750") wide by 16 mm (about 0.625") deep rectangular groove may hold a size 4 bar having a nominal 13 mm (about 0.500") diameter, with grout, epoxy, adhesive, or other materials filling any space between the bar and the groove.

Each groove in FIGS. 1B and 1C extends a distance longer than the width (or depth, which is the same as the width in this square pile but could be greater or less than the width in other embodiments) of the pile end. In other embodiments grooves may be the same or different lengths, and each groove may be longer or shorter in length when compared to a measurement taken across the face in which the groove is formed, or a measurement taken across another face or feature of the pile or of the mating pile. By way of a non-limiting example, grooves may be the same or about the same length in a pile as a width measured across the face where the grooves are formed. Grooves may be spaced to provide a minimum clear edge or groove spacing between any two grooves. The spacing between grooves may be the same or may vary between different grooves. By way of a non-limiting example, grooves may be about 25 mm (about 1 inch) apart, or 50 mm (2 inches), 75 mm (3 inches) or 100 mm (4 inches) apart, including ranges, fractions, and combinations of the above. The spacing of grooves may be measured on-center (e.g., centerline to centerline), or near edge to near edge (e.g., inside edge to inside edge between to grooves), or to the same edge (e.g., to the left edge of each groove) in specific embodiments, and may be uniform or variable across a face of a pile in specific embodiments. The number, sizes, spacing and arrangements of grooves may be larger or smaller as required for the application, and in particular may scale up or down with the size of the piles being joined. All features of grooves may be advantageously applied to both upper and lower piles in accordance with the subject invention.

Figure 1D:
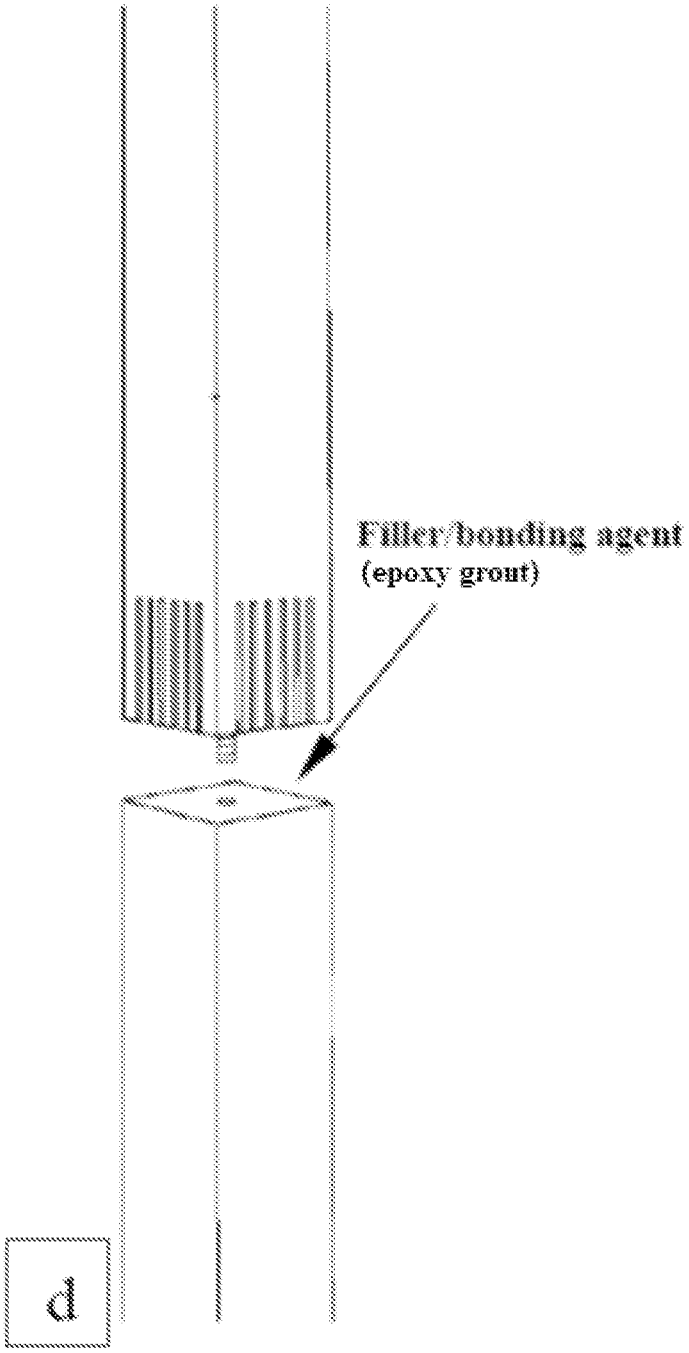

FIG. 1D shows the upper pile with alignment pin and grooves positioned above the lower pile with alignment hole. In practice the lower pile may be driven into the ground, seabed, riverbed, or other construction site while the upper pile may be suspended by a crane or other support at this point. In some embodiments additional structures on or attached to either pile may be used to guide or facilitate alignment between the two piles before or during assembly. The upper surface of the lower pile is indicated as an application point for a filler or bonding agent (e.g., epoxy grout.)

Figure 1E:
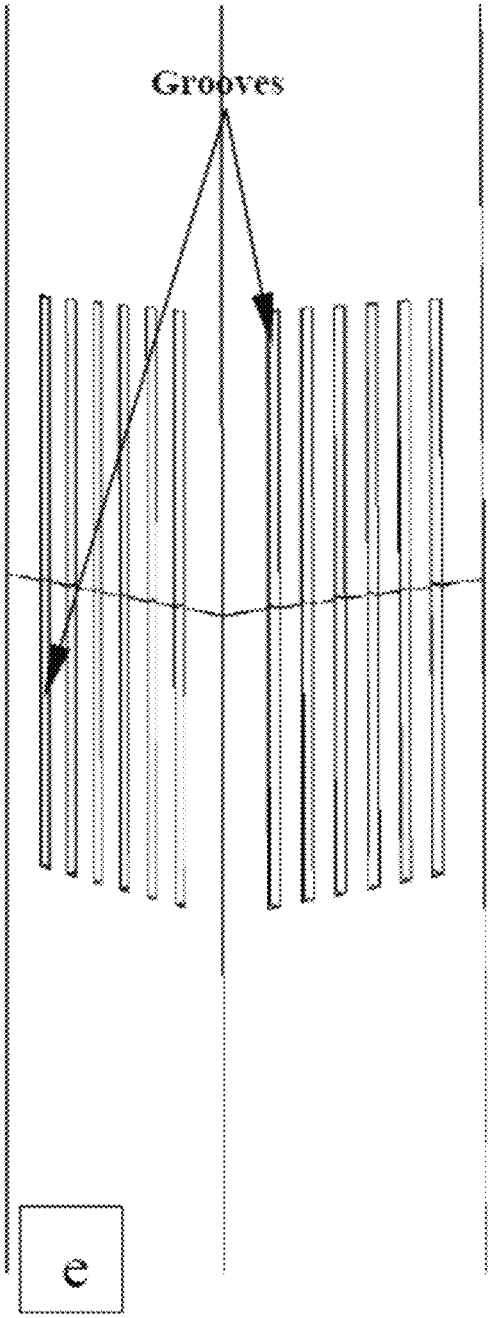

FIG. 1E shows the upper and lower piles, respectively assembled, with the alignment hole and alignment pin now hidden from view. Matching grooves have been created in the lower pile to align with the grooves in the upper pile. In some embodiments, these matching grooves may be prefabricated or added at the job site. Formation of the matching grooves may use the existing grooves in a first pile (e.g., prefabricated grooves in an upper pile) as guides, artifacts, templates, or references to form the grooves in a second pile (e.g., on-site fabricated grooves in a lower pile.) By way of a non-limiting example, a saw may be guided from a position within a groove on an upper pile and then moved downward to form a mating groove in a lower pile. In some embodiments, the grooves in the upper pile may be designed as undersized so that matching grooves in the lower pile may be cut with the same pass of the saw or other tool to create a well matched pair of grooves between two mating piles. In other embodiments, grooves may be cut by a template, gig, gauge, guide, controller or other method, system, or tool which may or may not reference another pile or one or more surfaces or features of the pile where the grooves are formed.

Figure 1F:
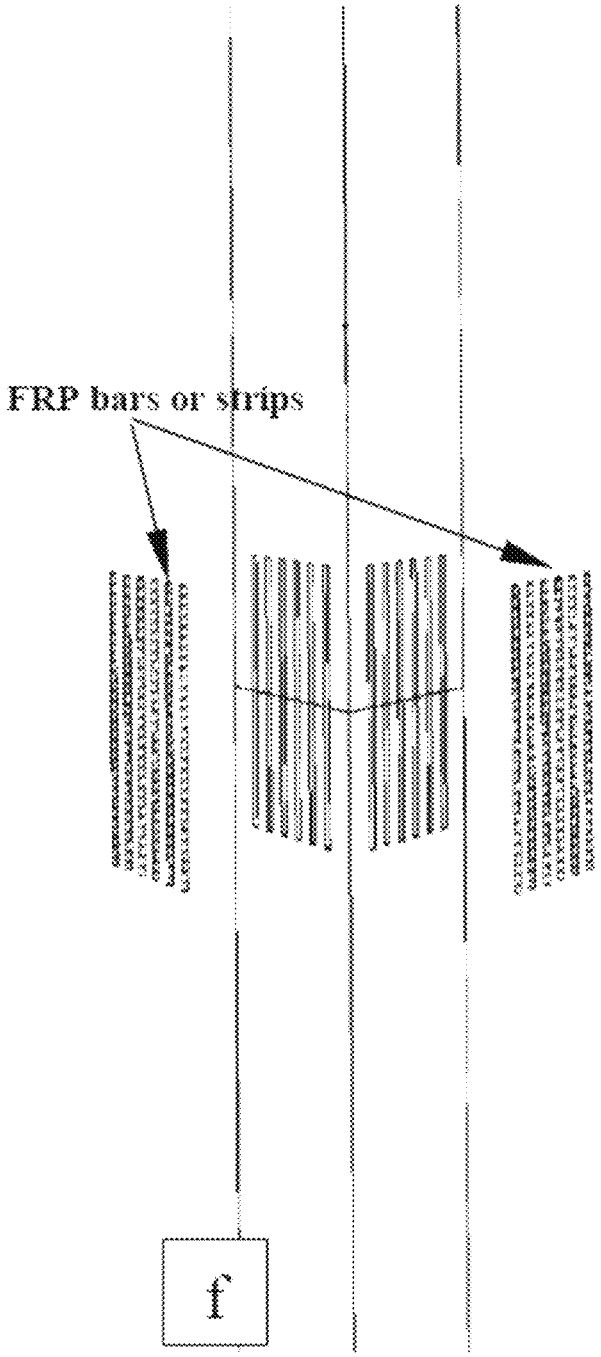

FIG. 1F shows FRP bars or strips ready for assembly into respective grooves extending across the mating upper pile and lower pile, respectively.

FIGS. 1A-1F may be used in a non-limiting example to describe a method of making or assembling an NSMB pile splice system according to the subject invention, including at least the following steps:

a) providing a lower pile to be spliced,
b) providing an upper pile to be spliced,
c) providing at least one alignment feature and a plurality of grooves at a lower end of the upper pile,
d) assembling the upper pile to the lower pile, providing a filler or bonding agent including epoxy grout at an upper end of the lower pile,
e) during or after assembling the upper pile to the lower pile, using the alignment feature to create a desired state of alignment of the upper pile to the lower pile, and fabricating a plurality of matching grooves in the lower pile such that when the desired state of alignment is maintained between the upper pile and the lower pile, a specific alignment is also maintained between the a plurality of grooves at a lower end of the upper pile\ and the plurality of matching grooves in the lower pile, and
f) providing a plurality of bars or strips configured to fill connect each of the plurality of grooves at a lower end of the upper pile to one of the plurality of matching grooves in the lower pile.

Figure 2:
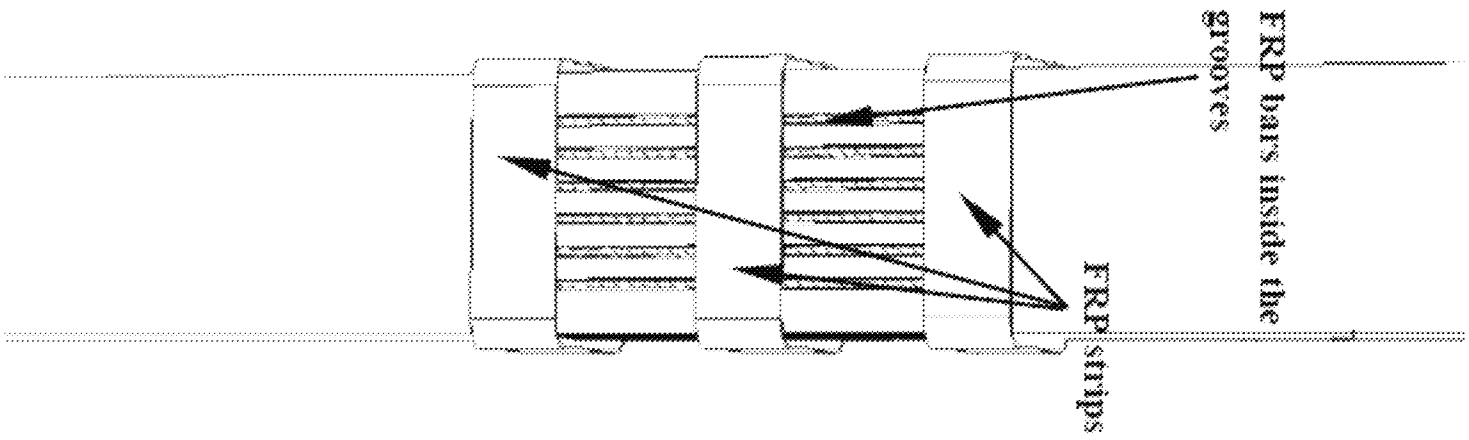
FIG. 2 illustrates an NSMB pile splice system including fiber reinforced plastic (FRP) reinforcing strips according to an embodiment of the subject invention.

FIG. 2 illustrates an NSMB pile splice system including fiber reinforced plastic (FRP) reinforcing strips according to an embodiment of the subject invention. The method described above with reference to FIGS. 1A-1F may also include further steps illustrated in FIG. 2, or not, such as providing a filler or bonding agent including epoxy grout at an upper end of the lower pile, securing the plurality of bars or strips with a filler or bonding agent, assembling one or more FRP strips around all or part of the upper pile, the lower pile, and the plurality of bars or strips, respectively, and other steps. The width, thickness, layering, composition, number, and design of the FRP strips may be selected for a given application. The embodiment shown in FIG. 2 has a first strip securing the top end of the bars at the upper end of the grooves in the upper pile, a second strip securing the joint where the upper pile meets the lower pile, and a third strip securing the bottom end of the bars at the lower end of the grooves in the lower pile. Alternative embodiments could use more or fewer strips, strips of greater or lesser height, strips at the same or different locations. By way of non-limiting examples, an embodiment may provide five strips, with three strips as shown in FIG. 2 and two additional strips of similar size spaced evenly between the three strips shown in FIG. 2; another embodiment may provide one large strips covering the entire area of the grooves across both the upper pile and lower pile (or more); and yet another embodiment may provide two strips at the top and bottom of the bars, respectively (similar to FIG. 2, but omitting one strip, e.g., the third strip securing the bottom end of the bars at the lower end of the grooves in the lower pile.) Other combinations and arrangements of strips are contemplated within the scope of the subject invention.

Figure 3:
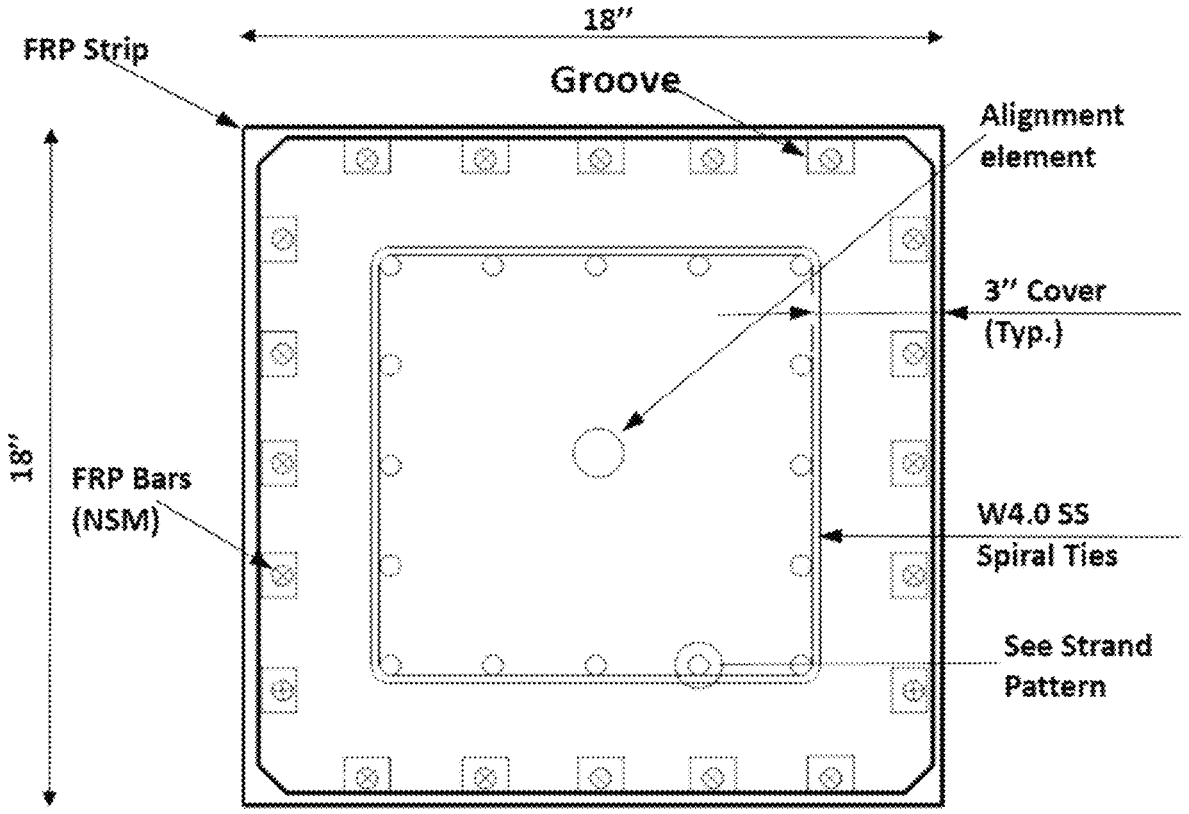
FIG. 3 illustrates an end view of a NSMB pile splice system design including one or more FRP reinforcing strips applied to a standard 18×18" pile according to an embodiment of the subject invention.

FIG. 3 illustrates an end view of a NSMB pile splice system design including one or more FRP reinforcing strips applied to a standard 18×18" (square) pile according to an embodiment of the subject invention. The outer dimensions of a reinforced concrete pile cross section are shown in green as 18" wide by 18" deep. An FRP strip is shown in blue, encircling the pile cross section. Five grooves are shown in white, cut into each side of the cross section in a near surface mount (NSM) configuration, making twenty grooves total, in a regular pattern along each side. An FRP Bar (NSM) is shown in each groove. An alignment element is shown in white at the center of the pile. Conventional reinforcement is noted with 3" cover (typical) of concrete above W4.0 SS Spiral Ties and a five strand pattern (counting the shared corner strands on each side) along each side.

Figure 4:
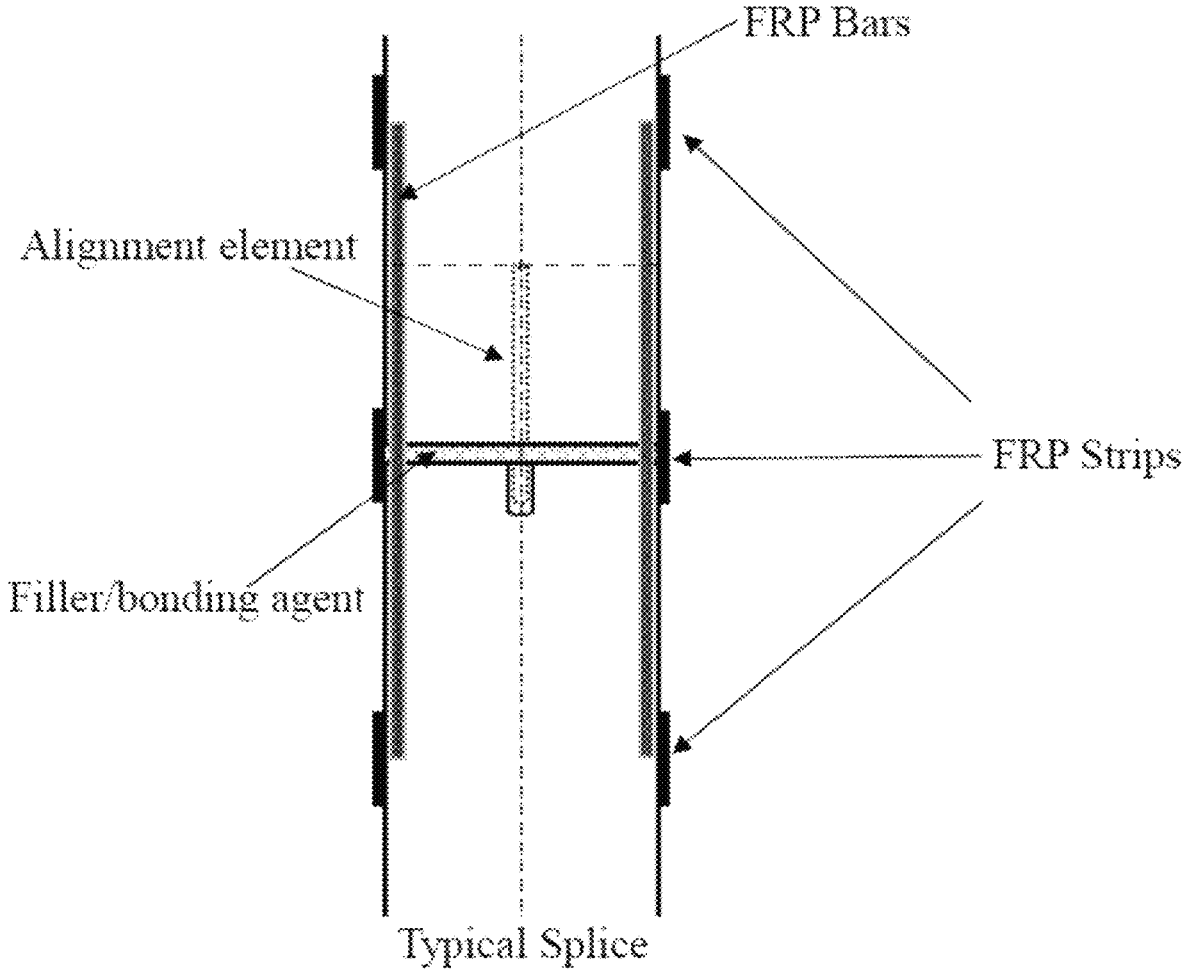
FIG. 4 illustrates a side view with hidden lines taken through an NSMB pile splice system, including FRP reinforcing strips and a filler or bonding agent applied at the interface of the upper pile with the lower pile, according to an embodiment of the subject invention.

FIG. 4 illustrates a side view with hidden lines taken through an NSMB pile splice system, including FRP reinforcing strips and a filler or bonding agent applied at the interface of the upper pile with the lower pile, according to an embodiment of the subject invention. An upper pile, with an internal hole and alignment feature (e.g., alignment pin) shown in yellow dashed lines at the center, sits atop a lower pile, with an internal hole and alignment feature (e.g., alignment hole) shown in yellow dashed lines at the center. A filler or bonding agent is shown in red between the upper pile and the lower pile. FRP bars are shown in purple cross section beneath the green outer edges of the upper pile and lower pile, respectively, and bridging across between the upper pile and lower pile. The FRP bars are displayed as fully filling the grooves (e.g., with line to line contact), such that the grooves are not visible in this view. Three FRP strips are shown in a solid yellow cross section, in a configuration similar to that shown in FIG. 2, with a first strip securing the top end of the bars at the upper end of the grooves in the upper pile, a second strip securing the joint where the upper pile meets the lower pile, and a third strip securing the bottom end of the bars at the lower end of the grooves in the lower pile. As described with respect to FIG. 2, alternative embodiments could use more or fewer strips, strips of greater or lesser height, strips at the same or different locations.

Embodiments provide innovative systems and methods to connect driven pile segments both in unforeseen and preplanned situations, providing excellent beneficial advantages especially for the unforeseen condition when other splice systems fail to provide the required capacity. The system may include FRP bars, strips and an alignment element. In an embodiment, when splicing is needed, the pile driving operation pauses, the upper pile segment is lowered and erected on top of the lower segment (FIG. 1D). To help the operation, an alignment pin protruded from the upper pile segment is placed into a hole at the center of the lower pile segment to facilitate the installation as well as ensure the alignment (FIG. 1C). This hole can be cast for the case of preplanned and drilled for the case of unforeseen splices. Filler or bonding compound (e.g., epoxy grout) is used inside the alignment hole in the lower segment and at the touching surfaces of the two pile segments. In the next step, for the case of unforeseen splicing, longitudinal grooves with required length and dimension are cut into the concrete cover of the pile segments on both sides of the splice at the joint location (FIG. 1E). For the case of preplanned splicing, the grooves can be precut at the precast plant. FRP bars are then placed into the grooves and bonded therein with a suitable grout or filler (e.g., epoxy or cementitious based material) (FIG. 1F). FIG. 1 shows a method for connecting driven pile segments in an unforeseen situation according to an embodiment of the subject invention, (a) drilling a hole in a lower pile segment, (b) and (c) cutting grooves and placing an alignment pin in an upper pile segment, (d) placing the upper segment on the lower segment, (e) cutting the same or corresponding dimension, alignment, and spacing of grooves in the lower segment, and (f) inserting the bars into the grooves with grout injection. It is contemplated within the scope of the subject invention that for the case of preplanned splicing, each segment can be prepared with some or all modifications before shipping to the site, at a remote location, or at the site but prior to installation, which makes methods of the subject invention even easier, more flexible, and faster to be implemented.

Many factors may be advantageously controlled in designing NSMB splice systems according to the subject invention, including but not limited to: (1) the mechanical properties of the selected FRP bars (e.g., CFRP bars with the modulus elasticity and tensile strength equal to 18000 ksi and 300 ksi, respectively), (2) the number as well as sizes of the FRP bars in each side (e.g., 5-#4 NSM FRP bars), (3) the required development length of the bars (e.g., to transfer the stresses to concrete and therefore to the strands in a pile) (e.g., bar with the development length equal to 2.4 ft.), (4) the depth and dimension of the grooves as well as their distance from each other and the edge of pile section (e.g., grooves with depth and dimension equal to 0.75 inch and with the clear spacing of 1.5 inch), and (5) the filler or bonding material properties (e.g., filler or bonding material with compressive strength of 2000 psi and 4000 psi in 2 hrs. and one day). Additionally, (6) the grout (e.g., filler, bonding agent, or epoxy) dimension and depth may advantageously be calculated in a way that inhibits debonding of FRP bars.

Near Surface Mounting (NSM) methods according to the subject invention can also be used with steel or metallic reinforcing bars, including normal, high strength, and stainless steel as well as other metallic materials which may have advantages including cost and availability. However, using FRP bars compared to steel or metallic bars in certain embodiments of the proposed systems or methods may provide many advantages such as resistance to corrosion, ease and speed of installation (due to its light weight), and a smaller required groove size (due to the higher tensile strength of FRP materials).

In embodiments of this splicing system, FRP strips in a transverse, axial, radial, angled, spiral, helical, or other direction (alone or in combination) may also be provided to serve as shear reinforcement and special restraint to debonding of bars at or near the splice. These strips can also cover a larger area (e.g., the entire length of a surface mounted splice bar plus 6 inches at both ends) with high strength and very thin thickness, serving as another layer of corrosion resistant barrier and structural support. The thickness and number of FRP strips as well as the spacing between them may be calculated for shear resistance and confinement. FIG. 2 shows one embodiment of an NSMB splice method according to the subject invention, after applying FRP strips.

Embodiments of the subject invention may be advantageous as compared to related art because; a) splices according to certain embodiments can be applied considerably easier, b) embodiments may require few, minor, or no modifications to the pile segments to be spliced, c) certain embodiments are very labor-friendly and can save a great deal of time, d) embodiments are durable and corrosion-resistant and may perform better in corrosive environment, e) embodiments are lightweight and environmentally friendly, f) embodiments provide for the required strength rapidly to allow driving of the pile to continue, g) certain embodiments overcome the shortcomings of unforeseen splices that are unable to provide the required splice strength, h) and embodiments are applicable to both pre-planned and unforeseen splices.

Embodiments of the subject invention will have major impact and considerably improve the construction operation for splicing driven piles. Certain embodiments may also significantly enhance the strength and durability of spliced piles, especially for unforeseen splice conditions. The durability of pile splices in marine and corrosive environments may also be increased remarkably through certain embodiments.

Embodiments are readily applicable to splicing of precast concrete piles for bridge and building foundations. While certain embodiments may be readily applied to primary targets including precast concrete piles, those same or other embodiments can easily be adapted for splicing other concrete pile types as well as assembling columns, piers, and other structural concrete prismatic elements.

With the importance of resiliency of bridges, especially in coastal and marine areas, and the level of support and interest from governmental and commercial agencies, there is a substantial potential for commercialization of the systems and methods of the subject invention.

The transitional term "comprising," "comprises," or "comprise" is inclusive or open-ended and does not exclude additional, unrecited elements or method steps. By contrast, the transitional phrase "consisting of" excludes any element, step, or ingredient not specified in the claim. The phrases "consisting" or "consists essentially of" indicate that the claim encompasses embodiments containing the specified materials or steps and those that do not materially affect the basic and novel characteristic(s) of the claim. Use of the term "comprising" contemplates other embodiments that "consist" or "consisting essentially of" the recited component(s).

When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

A greater understanding of the embodiments of the subject invention and of their many advantages may be had from the following examples, given by way of illustration.

The following examples are illustrative of some of the methods, applications, embodiments, and variants of the present invention. They are, of course, not to be considered as limiting the invention. Numerous changes and modifications can be made with respect to embodiments of the invention.

Example—Design and Analysis of Prototype Splice Designs

As a trial, based on the section analysis in ACI 440-07, NSMB splices were designed for 18×18" Florida Department of Transportation (FDOT) standard prestressed concrete pile using carbon fiber reinforced polymer (CFRP) bars (Table 1).

TABLE 1

Comparison of splice moment resistance for different number and sizes for CFRP bars

| Bar properties | | | | | | Moment | | | Groove | |
|---|---|---|---|---|---|---|---|---|---|---|
| Type | Size | Number of Bars in each side | Nominal Diameter (in.) | $f_{u_+}$ – ksi | $\varepsilon_{u_+}$ | $\varphi M_n$ – kip.ft | Development of Moment (%) | Development length (each side) – ft" | Length or Width (in.) | Min. Clear Edge or Groove Spacing (in.) |
| CFRP | 4 | 6 | ½ | 300 | 0.0167 | 275 | 115 | 2.4 | 0.75 | 3.00 |
| CFRP | 4 | 5 | ½ | 300 | 0.0167 | 258 | 108 | 2.7 | | |
| CFRP | 4 | 4 | ½ | 300 | 0.0167 | 217 | 90 | 2.7 | | |
| CFRP | 3 | 6 | ⅜ | 315 | 0.0175 | 199 | 84 | 2.2 | 0.56 | 2.25 |
| CFRP | 3 | 7 | ⅜ | 315 | 0.0175 | 224 | 95 | 2.2 | | |
| CFRP | 3 | 8 | ⅜ | 315 | 0.0175 | 248 | 104 | 2.1 | | |

For this system for a sample 18×18-in pile, a series of splice system designs using various CFRP bar sizes and configurations were developed. The results are included in Table 1. As shown in Table 1, as an example, prestressed pile splices with 5 CFRP #4 bars (half inch diameter with modulus of elasticity of 18 ksi) on each side can accommodate more than the required moment for 18×18" pile (See FIG. 3).

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A near-surface mounting bar (NSMB) pile splicing system for connecting prestressed-precast concrete pile segments, the system comprising:

a lower pile comprising prestressed-precast concrete, the prestressed-precast concrete of the lower pile having a lower end face and at least one lower lateral face;

an upper pile comprising prestressed-precast concrete, the prestressed-precast concrete of the upper pile having an upper end face and at least one upper lateral face; and a splice connecting the upper pile and the lower pile, the splice comprising:

a plurality of lower surface mount grooves on the at least one lower lateral face;

a plurality of upper surface mount grooves on the at least one upper lateral face; and a plurality of NSMBs connecting the plurality of lower surface mount grooves to the plurality of upper surface mount grooves, the plurality of NSMBs being fiber reinforced plastic bars, the plurality of NSMBs being configured to be grouted or bonded in place within the plurality of lower surface mount grooves or the plurality of upper surface mount grooves, and the plurality of NSMBs being in physical contact with the prestressed-precast concrete of the lower pile and the prestressed-precast concrete of the upper pile.

2. The system according to claim 1, further comprising:

a lower alignment element on the lower pile;

an upper alignment element on the upper pile; and a first reinforcing strip encircling a portion of the lower pile, a portion of the upper pile, or both.

3. The system according to claim 2, further comprising:

a lower reinforcing strip encircling a portion of the lower pile, a portion of the lower lateral face, a portion of the plurality of lower surface mount grooves, and a portion of the plurality of NSMBs.

4. The system according to claim 3, further comprising:

an upper reinforcing strip encircling a portion of the upper pile, a portion of the upper lateral face, a portion of the plurality of upper surface mount grooves, and a portion of the plurality of NSMBs.

5. The system according to claim 4, the first reinforcing strip encircling the lower end face and the upper end face, the lower reinforcing strip encircling a lower end of one or more of the plurality of NSMBs, and the upper reinforcing strip encircling an upper end of one or more of the plurality of NSMBs.

6. The system according to claim 2, the lower pile being a prismatic pile comprising four planar lower lateral faces, the upper pile being a prismatic pile comprising four planar upper lateral faces, the lower alignment element being a cylindrical hole drilled, bored, or cast into a central region of the lower end face, and the upper alignment element being a cylindrical protrusion projecting from a central region of the upper end face, such that when the lower alignment element engages with the upper alignment element, the lower end face aligns with the upper end face, and each of the four planar lower lateral faces aligns with a corresponding one of the four planar upper lateral faces.

7. The system according to claim 6, each of the four planar lower lateral faces comprising a respective lower surface mount groove of the plurality of lower surface mount grooves, and each of the four planar upper lateral faces comprising a respective upper surface mount groove of the plurality of upper surface mount grooves, such that when each of the four planar lower lateral faces aligns with a corresponding one of the four planar upper lateral faces, each respective lower surface mount groove aligns with each respective corresponding upper surface mount groove to form a respective splicing groove configured to receive the respective NSMB connecting the respective lower surface mount groove to the respective upper surface mount groove.

8. The system according to claim 2, further comprising a filler or bonding agent connecting one or more of:

the lower end face to the upper end face;

the lower alignment element to the upper alignment element; and the plurality of NSMBs to the plurality of lower surface mount grooves, the plurality of upper surface mount grooves, or both.

9. The system according to claim 1, the plurality of NSMBs comprising a round, oval, elliptical, prismatic, rectilinear, rectangular, or square cross section, the plurality of lower surface mount grooves comprising cast, cut, or ground grooves comprising a round, oval, elliptical, prismatic, rectilinear, rectangular, or square cross section, the plurality of upper surface mount grooves comprising cast, cut, or ground grooves comprising a round, oval, elliptical, prismatic, rectilinear, rectangular, or square cross section, and each groove of the plurality of lower surface mount grooves configured to align with a respective one of the plurality of upper surface mount grooves to receive a respective one of the plurality of NSMBs secured in place and inhibited from debonding by a bonding agent.

10. The system according to claim 9, the plurality of lower surface mount grooves comprising rectangular grooves between 15 mm and 38 mm in either depth or width or both, the plurality of upper surface mount grooves comprising rectangular grooves between 15 mm and 38 mm in either depth or width or both, the plurality of NSMBs comprising bars between 9 mm and 25.4 mm in either diameter or width, and a length of each of the plurality of NSMBs being equal to or less than a length of a corresponding one of the plurality of lower surface mount grooves plus a length of a corresponding one of the plurality of upper surface mount grooves, such that when each of the plurality of NSMBs connects a corresponding one of the plurality of lower surface mount grooves to a corresponding one of the plurality of upper surface mount grooves, a total gap between 3 mm and 6 mm is formed around each respective bar within each respective groove, and the gap being filled by the bonding agent in a way that inhibits debonding of each respective bar.

11. A method for connecting driven pile segments, the method comprising the following steps:

forming a lower alignment feature in a lower pile segment;

forming an upper alignment feature in an upper pile segment;

placing the upper pile segment on the lower pile segment;

engaging the upper alignment feature with the lower alignment feature to align the upper pile segment to the lower pile segment;

forming a plurality of lower surface mount grooves in a lower lateral face of the lower pile segment;

forming a plurality of upper surface mount grooves in an upper lateral face of the upper pile segment;

inserting a respective bar of a plurality of near surface mount bars (NSMBs) into a respective groove of the plurality of lower surface mount grooves and into a corresponding one of the plurality of upper surface mount grooves; and securing each respective bar with grout injection to form a near surface mount splice, the plurality of NSMBs being fiber reinforced plastic bars, and the plurality of NSMBs being in physical contact with prestressed-precast concrete of the lower pile segment and prestressed-precast concrete of the upper pile segment.

12. The method according to claim 11, each respective groove of the plurality of lower surface mount grooves being of a similar size, shape, position, and alignment with respect to a corresponding one of the plurality of upper surface mount grooves to facilitate inserting each respective bar with grout injection.

13. The method according to claim 12, further comprising the step of securing each respective bar with at least one fiber reinforced polymer strip encircling at least a portion of the lower pile segment, the upper pile segment, or both.

14. The method according to claim 13, the lower alignment feature being a hole, the upper alignment feature being an alignment pin, and the step of engaging the upper alignment feature with the lower alignment feature comprising inserting the alignment pin into the hole to bring the upper pile segment into alignment with the lower pile segment.

15. The method according to claim 14, the step of forming a plurality of lower surface mount grooves in the lower pile segment occurring at a construction site and after the step of engaging the upper alignment feature with the lower alignment feature to align the upper pile segment to the lower pile segment.

16. The method according to claim 15, each respective groove of the plurality of lower surface mount grooves being formed with a similar size, shape, position, and alignment by physical reference to a corresponding one of the plurality of upper surface mount grooves.

17. The method according to claim 15, the lower alignment feature being formed at the construction site, and at least in part by drilling, boring, or cutting into the lower pile segment.

18. The method according to claim 15, the lower alignment feature being formed prior to a delivery of the lower pile segment at the construction site, and at least in part by casting, drilling, boring, or cutting a hole into the lower pile segment.

19. A near-surface mounting bar (NSMB) pile splicing system for connecting prestressed-precast concrete pile segments, the system comprising:

a lower pile comprising prestressed-precast concrete, the lower pile having a lower end face and at least one lower lateral face;

an upper pile comprising prestressed-precast concrete, the upper pile having an upper end face and at least one upper lateral face; and a splice connecting the upper pile and the lower pile, the splice comprising:

a plurality of lower surface mount grooves on the lower lateral face;

a plurality of upper surface mount grooves on the upper lateral face;

a plurality of near surface mount bars (NSMBs) connecting the plurality of lower surface mount grooves to the plurality of upper surface mount grooves;

a lower alignment element on the lower pile;

an upper alignment element on the upper pile;

a first reinforcing strip encircling a portion of the lower pile, a portion of the upper pile, or both;

a lower reinforcing strip encircling a portion of the lower pile, a portion of the lower lateral face, a portion of the plurality of lower surface mount grooves, and a portion of the plurality of NSMBs; and an upper reinforcing strip encircling a portion of the upper pile, a portion of the upper lateral face, a portion of the plurality of upper surface mount grooves, and a portion of the plurality of NSMBs, the first reinforcing strip encircling the lower end face and the upper end face, the lower reinforcing strip encircling a lower end of one or more of the plurality of NSMBs, and the upper reinforcing strip encircling an upper end of one or more of the plurality of NSMBs.

20. The system according to claim 19, the lower pile being a prismatic pile comprising four planar lower lateral faces, the upper pile being a prismatic pile comprising four planar upper lateral faces, the lower alignment element being a cylindrical hole drilled, bored, or cast into a central region of the lower end face, the upper alignment element being a cylindrical protrusion projecting from a central region of the upper end face, so that when the lower alignment element engages with the upper alignment element, the lower end face aligns with the upper end face, and each of the four planar lower lateral faces aligns with a corresponding one of the four planar upper lateral faces, each of the four planar lower lateral faces comprising a respective lower surface mount groove of the plurality of lower surface mount grooves, each of the four planar upper lateral faces comprising a respective upper surface mount groove of the plurality of upper surface mount grooves, such that when each of the four planar lower lateral faces aligns with a corresponding one of the four planar upper lateral faces, each respective lower surface mount groove aligns with each respective corresponding upper surface mount groove to form a respective splicing groove configured to receive the respective NSMB connecting the respective lower surface mount groove to the respective upper surface mount groove, a filler or bonding agent connecting one or more of:

the lower end face to the upper end face;

the lower alignment element to the upper alignment element; and the plurality of NSMBs to the plurality of lower surface mount grooves, the plurality of upper surface mount grooves, or both, the plurality of NSMBs comprising metallic, steel, stainless steel, or fiber reinforced plastic bars comprising a round, oval, elliptical, prismatic, rectilinear, rectangular, or square cross section, the plurality of lower surface mount grooves comprising cast, cut, or ground grooves comprising a round, oval, elliptical, prismatic, rectilinear, rectangular, or square cross section, the plurality of upper surface mount grooves comprising cast, cut, or ground grooves comprising a round, oval, elliptical, prismatic, rectilinear, rectangular, or square cross section, each groove of the plurality of lower surface mount grooves configured to align with a respective one of the plurality of upper surface mount grooves to receive a respective one of the plurality of NSMBs secured in place and inhibited from debonding by the bonding agent, the plurality of lower surface mount grooves comprising rectangular grooves between 15 mm and 38 mm in either depth or width or both, the plurality of upper surface mount grooves comprising rectangular grooves between 15 mm and 38 mm in either depth or width or both, the plurality of NSMBs comprising bars between 9 mm and 25.4 mm in either diameter or width, a length of each of the plurality of NSMBs being equal to or less than a length of a corresponding one of the plurality of lower surface mount grooves plus a length of a corresponding one of the plurality of upper surface mount grooves, such that when each of the plurality of NSMBs connects a corresponding one of the plurality of lower surface mount grooves to a corresponding one of the plurality of upper surface mount grooves, a total gap between 3 mm and 6 mm is formed around each respective bar within each respective groove, and the gap being filled by the bonding agent in a way that inhibits debonding of each respective bar.

* * * * *